US009461406B2

(12) United States Patent
Okamoto et al.

(10) Patent No.: US 9,461,406 B2
(45) Date of Patent: Oct. 4, 2016

(54) CONNECTOR

(75) Inventors: Ryoya Okamoto, Yokkaichi (JP); Hiroomi Hiramitsu, Yokkaichi (JP); Hiroki Hirai, Yokkaichi (JP); Masakuni Kasugai, Osaka (JP)

(73) Assignees: Sumitomo Wiring Systems, Ltd., Yokkaichi, Mie (JP); AutoNetworks Technologies, Ltd., Yokkaichi, Mie (JP)

( * ) Notice: Subject to any disclaimer, the term of this patent is extended or adjusted under 35 U.S.C. 154(b) by 70 days.

(21) Appl. No.: 14/008,777

(22) PCT Filed: Apr. 9, 2012

(86) PCT No.: PCT/JP2012/059656
§ 371 (c)(1),
(2), (4) Date: Sep. 30, 2013

(87) PCT Pub. No.: WO2012/141127
PCT Pub. Date: Oct. 18, 2012

(65) Prior Publication Data

US 2014/0199868 A1 Jul. 17, 2014

(30) Foreign Application Priority Data

Apr. 13, 2011 (JP) ..... 2011-089129

(51) Int. Cl.
*H01R 12/91* (2011.01)
*H01R 13/187* (2006.01)
(Continued)

(52) U.S. Cl.
CPC ..... *H01R 13/6315* (2013.01); *H01R 13/14* (2013.01)

(58) Field of Classification Search
CPC H01R 13/6315; H01R 13/629; H01R 12/91; H01R 13/187
USPC ..... 439/247, 248
See application file for complete search history.

(56) References Cited

U.S. PATENT DOCUMENTS 4,909,748 A * 3/1990 Kozono et al. ..... 439/247
5,201,663 A * 4/1993 Kikuchi et al. ..... 439/83
(Continued)

FOREIGN PATENT DOCUMENTS

JP 11-299054 10/1999
JP 2002-42961 2/2002
(Continued)

OTHER PUBLICATIONS

English Translation of Komuro et al. JP 2005129454, published May 19, 2005, Translation made Jul. 8, 2015.*
(Continued)

*Primary Examiner* — Amy Cohen Johnson
*Assistant Examiner* — Matthew T Dzierzynski
(74) *Attorney, Agent, or Firm* — Gerald E. Hespos; Michael J. Porco; Matthew T. Hespos

(57) ABSTRACT

A connector (1) collectively connects terminals (10) of a plurality of devices (11) by being fit to a stacked body (12) in which the plurality of devices are stacked. The connector (1) includes a terminal main portion (2) with a plurality of independent fitting portions (21 to 24) for connection to the respective terminals (10) of the devices (11). The connector (1) also has a terminal holding portion (3) for supporting and uniting the terminal main portion (2). Connecting portions (51 to 53) connect the fitting portions (21 to 24) and the terminal holding portion (3) and are formed as tolerance absorbing portions capable of absorbing a tolerance due to the stacking of the devices by a resilient force.

7 Claims, 10 Drawing Sheets

(51) Int. Cl.
*H01R 13/631* (2006.01)
*H01R 13/14* (2006.01)

(56) References Cited

U.S. PATENT DOCUMENTS 5,769,652 A * 6/1998 Wider ..... 439/248
6,039,590 A * 3/2000 Kunishi ..... 439/247
7,354,282 B2 * 4/2008 Margulis et al. ..... 439/79
7,361,041 B2 * 4/2008 Hashiguchi et al. ..... 439/247
7,393,228 B2 * 7/2008 Kabasawa et al. ..... 439/247
7,628,628 B2 * 12/2009 Matsuda et al. ..... 439/248
8,672,696 B2 * 3/2014 Sakurai ..... 439/247
8,974,237 B2 * 3/2015 Wehrle et al. ..... 439/83
2011/0294326 A1 * 12/2011 Tanaka et al. ..... 439/248
2014/0120760 A1 * 5/2014 Zieman et al. ..... 439/357

FOREIGN PATENT DOCUMENTS

JP 2005-123109 5/2005
JP 2005129454 A * 5/2005 ..... H01R 13/74
JP 2007-242251 9/2007
JP 2008-198429 8/2008
JP 2009-140705 6/2009

OTHER PUBLICATIONS

International Search Report of May 15, 2012.

* cited by examiner

CONNECTOR

BACKGROUND

1. Field of the Invention

This invention relates to a connector capable of collectively connecting terminals of a plurality of devices.

2. Description of the Related Art

In some cases, a stacked body 103 is assembled by stacking a plurality of devices 102 such as substrates each including a terminal 101, for example, as shown in FIG. 10, thereby forming one equipment. A connector fitting portion 104 is formed on an end part of the stacked body 103 of the devices.

As shown in FIG. 10, the terminals 101 of the plurality of devices 102 can be collectively connected by a connector 201 by fitting the connector 201 into the connector fitting portion 104 of the stacked devices 103.

Since the connector fitting portion 104 of the stacked body 103 of the plurality of devices has a tolerance due to the stacking of the devices 102, the positions of the terminals deviate from design values. In the case of connecting the connector 201 to the devices by directly fitting the connector 201 into the connector fitting portion 102, the connector 201 needs to be fitted in consideration of the tolerance due to the stacking. Specifically, displacements of the terminals 101 of the connector fitting portion 102 due to the tolerance need to be absorbed by a certain means.

Conventionally, a method, for example, disclosed in Japanese Unexamined Patent Publication No. H11-299054 is known as a means for absorbing such displacements of the terminals between the connector 201 and the terminals 1011.

The method disclosed in Japanese Unexamined Patent Publication No. H11-299054 is such that a connector housing is formed structurally separately from a main cover, the main cover is provided with an opening larger than the outer periphery of the connector housing, the connector housing is movably held in the opening by a flexible and scissible holding portion, a moving space for the connector housing larger than the height of tab terminals is formed between the connector housing and a wiring board and a connector portion is formed by passing the tab terminals into insertion holes of the connector housing after the holding portion is cut.

However, the connector disclosed in Japanese Unexamined Patent Publication No. H11-299054 is not connected to a connector fitting portion formed by stacking a plurality of devices. Japanese Unexamined Patent Publication No. H11-299054 discloses a basic configuration different from the one in the case of connecting the terminals of the stacked devices as shown in FIG. 10.

Conventionally, a tolerance in the case of stacking a plurality of devices as shown in FIG. 10 has been corrected by correcting displacements of the terminal positions on the stacked devices. However, it requires an extreme amount of time and effort to correct the tolerance on the device side, which leads to a cost increase.

Further, since the tolerance cannot be conventionally absorbed on the connector side, there has been a problem that it is impossible to fit the connector to the devices for connection to the terminals if the tolerance is insufficiently corrected on the device side.

An object of the present invention is to solve the above problem residing in the prior art and provide a connector which, when being fitted into a connector fitting portion formed by stacking a plurality of devices and connected to terminals of the devices, can be easily fitted into the connector fitting portion of the devices by absorbing a stacking tolerance of the devices and can reliably connect the terminals.

SUMMARY OF THE INVENTION

To solve the above problem, the present invention is directed to a connector for collectively connecting terminals of a plurality of devices each including a terminal on an end part by being fitted to a stacked body in which the plurality of devices are stacked, including a terminal main portion including a plurality of independent fitting portions for connection to the respective terminals of the devices; a terminal holding portion for supporting and uniting the terminal main portion; and a tolerance absorbing portion connecting the fitting portions and the terminal holding portion and capable of absorbing a tolerance due to the stacking of the devices by a resilient force.

In the above connector, the tolerance absorbing portion is preferably provided for each independent fitting portion so as to be able to independently absorb the tolerance.

In the above connector, the tolerance absorbing portion is preferably composed of integrally formed resin springs which connect the fitting portions and the terminal holding portion.

In the above connector, at least one of the plurality of fitting portions is preferably fixed to the terminal holding portion.

In the above connector, the tolerance absorbing portion is preferably provided on rear end parts of the fitting portions.

The connector of the present invention includes the terminal holding portion, the terminal main portion including the plurality of independent fitting portions for connection to the respective terminals of the devices, and the tolerance absorbing portion connecting the fitting portions and the terminal holding portion and capable of absorbing a tolerance due to the stacking of the devices by a resilient force, whereby the tolerance due to the stacking of the devices of the stacked body can be absorbed by the tolerance absorbing portion on the connector side. Thus, even if the positions of the terminals of the stacked body of the devices vary due to the tolerance, the fitting portions of the connector can follow, the connector can be easily fitted into the connector fitting portion of the devices and the terminals can be reliably connected.

DETAILED DESCRIPTION OF THE PREFERRED EMBODIMENTS

Figure 1:
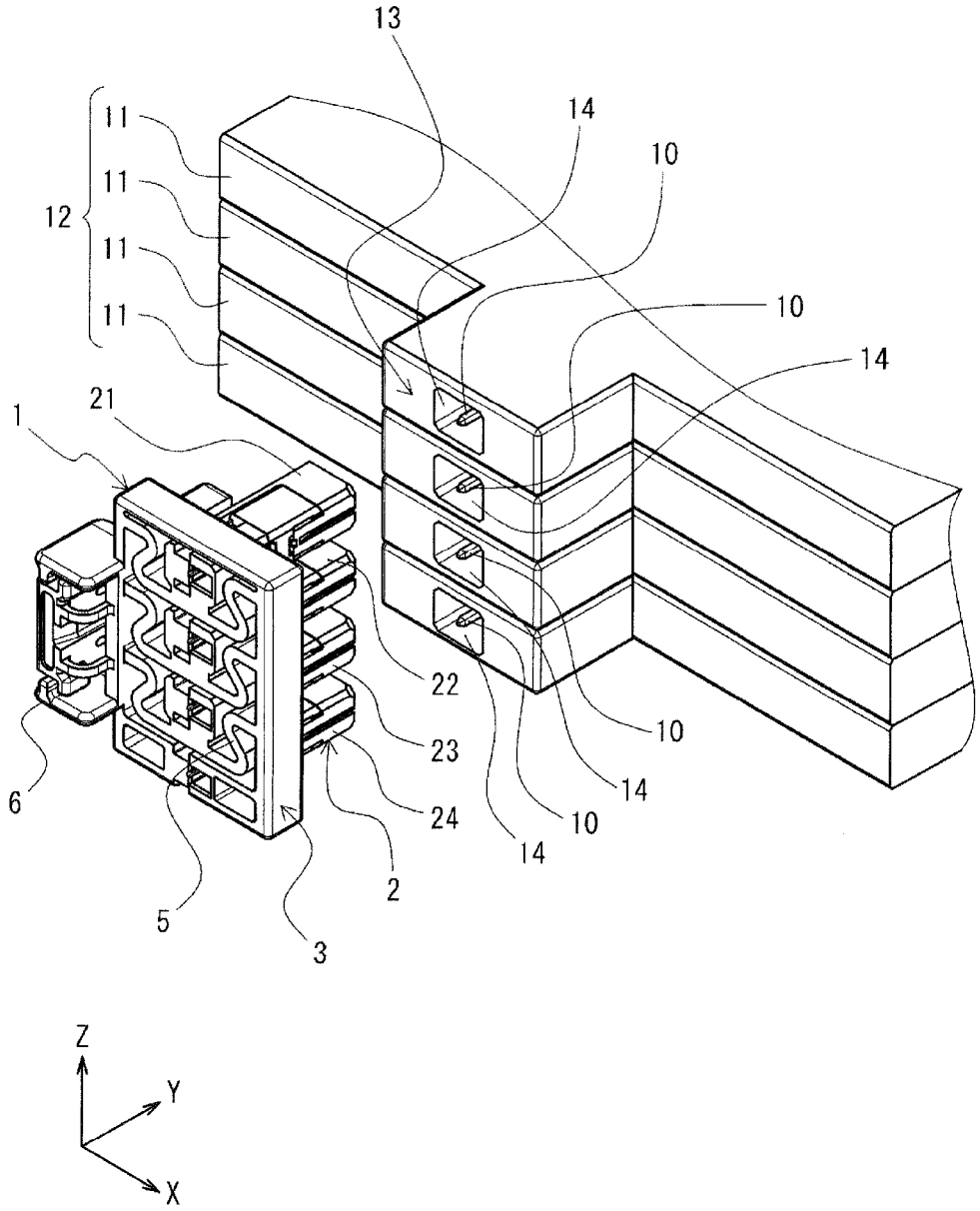
FIG. 1 is a perspective view showing a connector of the present invention and a connector fitting portion.

Hereinafter, an embodiment of the present invention is described in detail using the drawings. FIG. 1 is a perspective view showing one embodiment of a connector of the present invention and a connector fitting portion. As shown in FIG. 1, the connector 1 of the present invention is a connector for collectively connecting terminals 10 of a plurality of devices 11 such as substrates each including the terminal 10 on an end part by being fitted to a stacked body 12 in which the plurality of devices 11 are stacked. The connector 1 of this embodiment shown in FIG. 1 is a connector for collectively connecting four terminals 10 of the stacked body 12 in which four devices 11 are stacked. In each device 11, a recess 14 into which a cavity of the connector is fittable is formed around the terminal 10. In the stacked body 12, a collection of the recesses 14 around the terminals 10 is formed as a connector fitting portion 13.

In the stacked body 12 in which the devices 11 are stacked, the respective recesses 14 of the connector fitting portion 13 and the terminals 10 are displaced due to a tolerance in a stacking direction (Z direction in FIG. 1), a tolerance in a horizontal (lateral) direction (X direction in FIG. 1) perpendicular to the stacking direction and the like. The connector of this embodiment is so configured that the tolerances in two directions due to the stacking of these devices can be absorbed by a tolerance absorbing portion.

Figure 2:
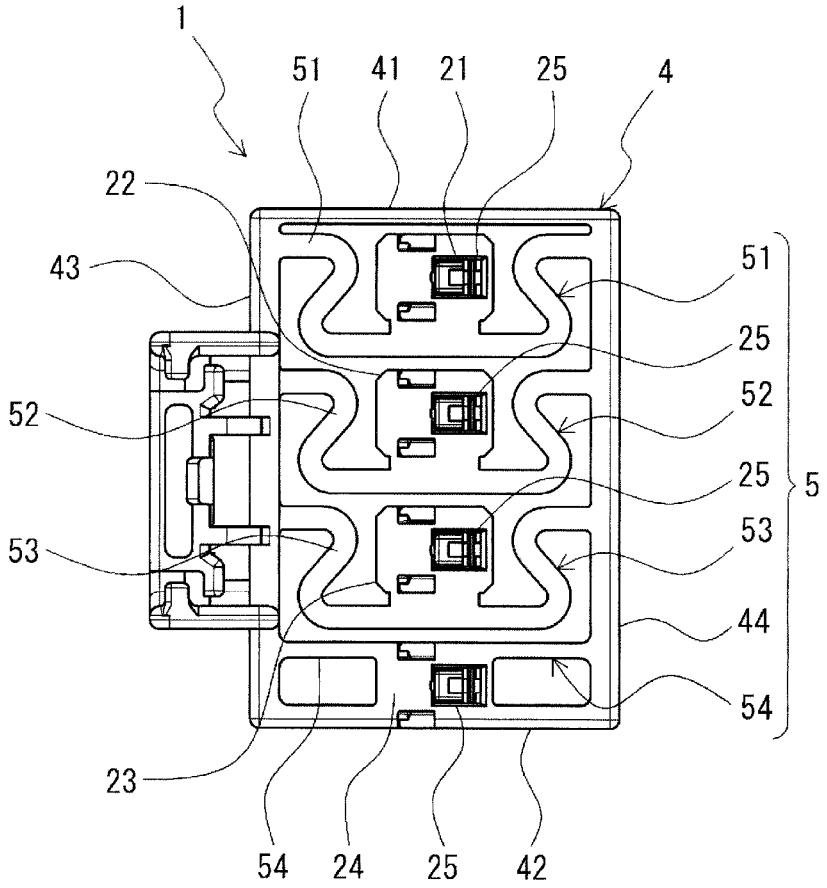
FIG. 2 is a front view of the connector of FIG. 1.
Figure 3:
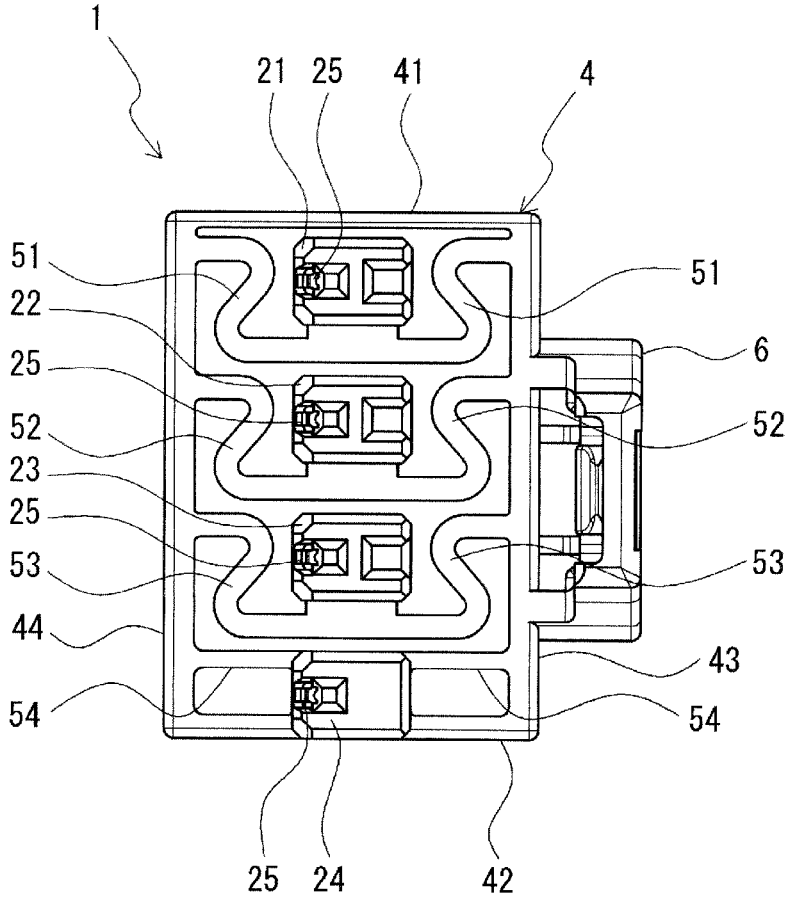
FIG. 3 is a rear view of the connector of FIG. 1.
Figure 4:
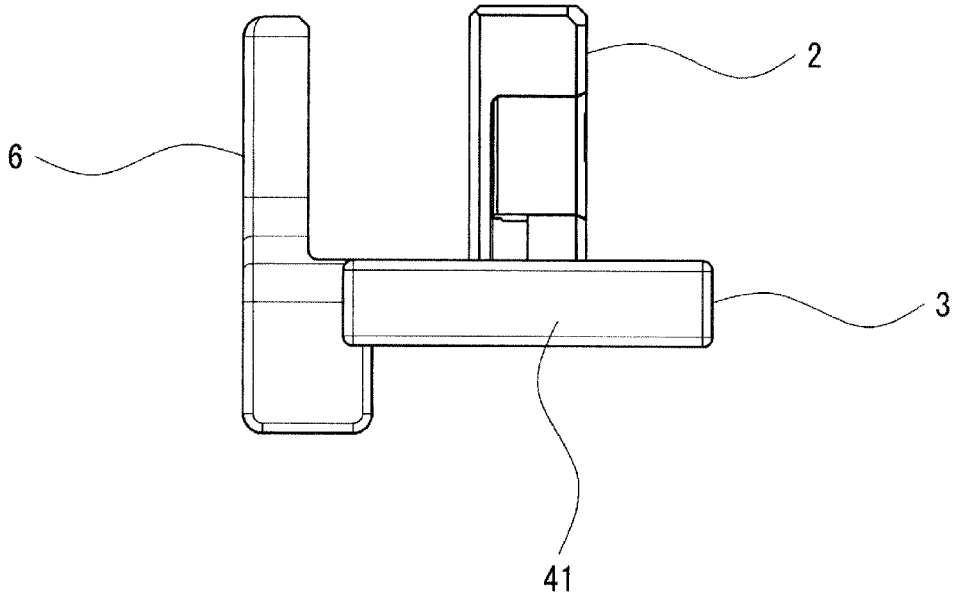
FIG. 4 is a plan view of the connector of FIG. 1.
Figure 5:
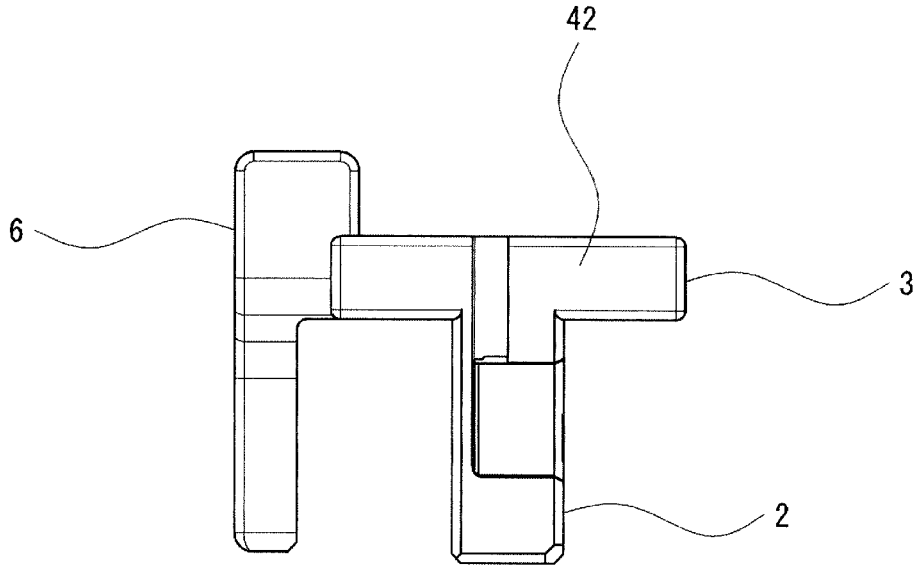
FIG. 5 is a bottom view of the connector of FIG. 1.
Figure 6:
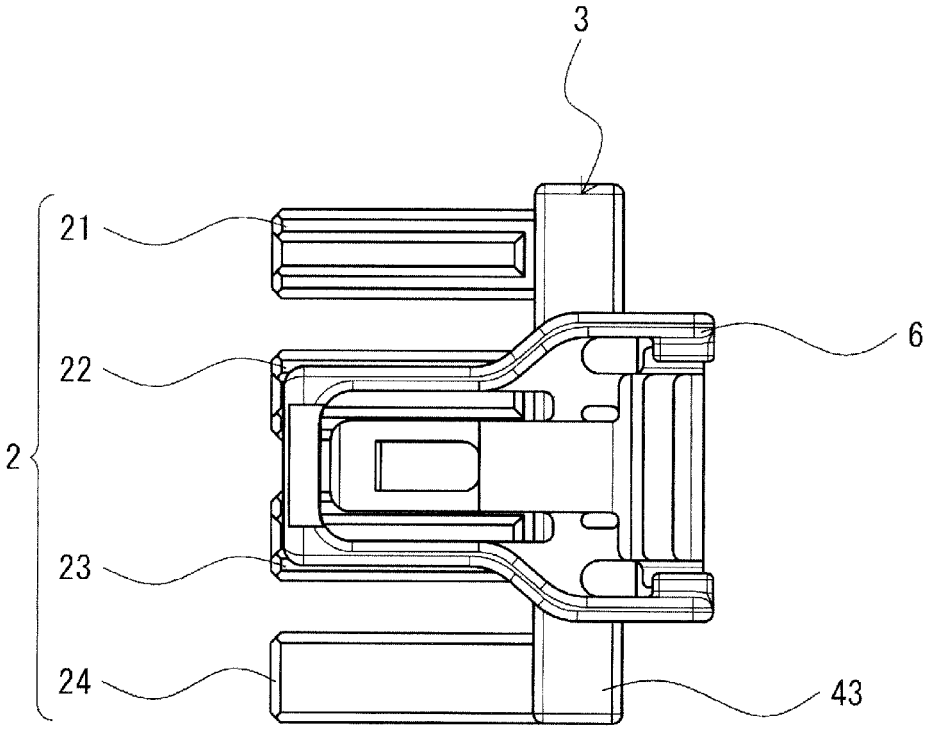
FIG. 6 is a left side view of the connector of FIG. 1.
Figure 7:
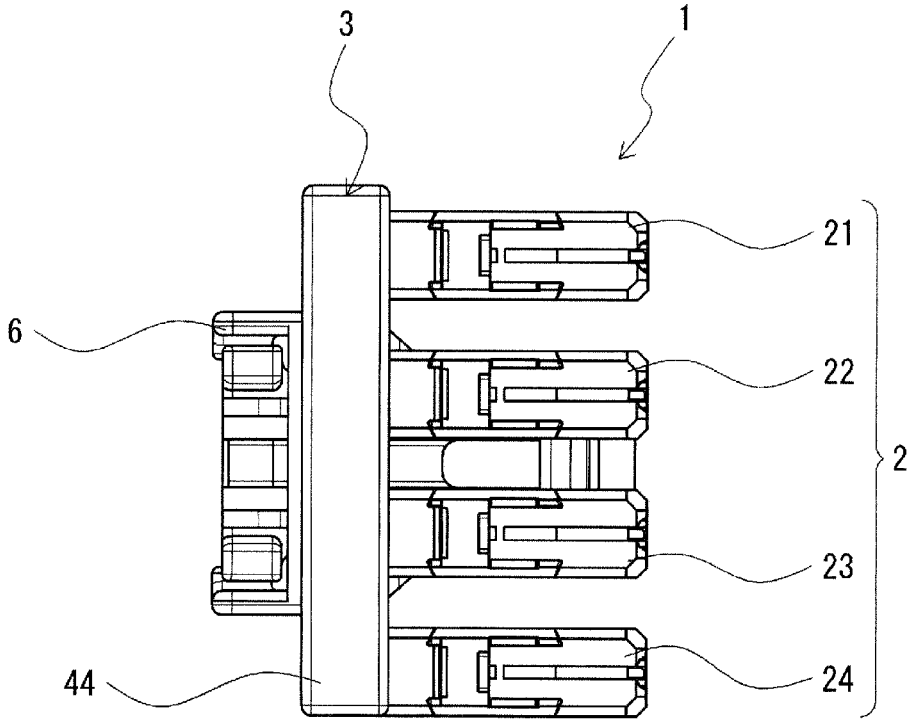
FIG. 7 is a right side view of the connector of FIG. 1.

FIG. 2 is a front view of the connector of FIG. 1, FIG. 3 is a rear view of the connector of FIG. 1, FIG. 4 is a plan view of the connector of FIG. 1, FIG. 5 is a bottom view of the connector of FIG. 1, FIG. 6 is a left side view of the connector of FIG. 1, and FIG. 7 is a right side view of the connector of FIG. 1. As shown in FIGS. 1 to 7, the connector 1 includes a terminal main portion 2 composed of four separate and independent protrusions fittable into the four recesses 14 provided on the respective devices 11 for connection to the respective terminals 10 of the stacked body 12 of the devices.

The terminal main portion 2 is configured by successively arranging four fitting portions composed of a first fitting portion 21, a second fitting portion 22, a third fitting portion 23 and a fourth fitting portion 24 at predetermined intervals from top in FIG. 1 in a vertical row. The respective fitting portions 21 to 24 are arranged in the same direction as the stacking direction of the devices 11. The connector 1 is electrically connected to the terminals 10 of the connector fitting portion 13 by fitting the fitting portions 21 to 24 into the connector fitting portion 13 of the devices.

The fitting portions 21 to 24 are identically shaped. The fitting portions 21 to 24 are in the form of tubes having a rectangular cross-section. The fitting portions 21 to 24 are chamfered. A female terminal 25 formed to be connectable to the male terminal 10 of the device 11 is mounted in each cavity provided in each of the fitting portions 21 to 24.

When the tips of the fitting portions 21 to 24 are fitted into the respective recesses 14 of the connector fitting portion 13 of the device side, sides of the terminals 25 near the devices 11 (referred to as front sides for convenience) are electrically connected to the mating terminals 10 of the connector fitting portion 13. Sides of the respective terminals 25 of the respective fitting portions opposite to those near the device side (referred to as rear sides for convenience) are electrically connected to terminals (not shown) of a wiring harness.

The connector 1 includes a terminal holding portion 3 for supporting and uniting a plurality of independent fitting portions 21 to 24 of the terminal main portion 2. The terminal holding portion 3 is formed around rear end parts of the above fitting portions 21 to 24.

As shown in FIGS. 2 and 3, the terminal holding portion 3 is composed of a rectangular outer frame 4 surrounding end parts of the fitting portions 21 to 24 and a connecting portion 5 (51 to 54) for connecting the respective terminal portions 21 to 24 to the outer frame 4. The outer frame 4 is composed of four plate-like bodies including an upper plate 41, a bottom plate 42, a left side plate 43 and a right side plate 44.

The connecting portion 5 includes first connecting portions 51 for connecting the first fitting portion 21 and the side plates 43, 44 of the outer frame 4, second connecting portions 52 for connecting the second fitting portion 22 and the side plates 43, 44 of the outer frame 4, third connecting portions 53 for connecting the third fitting portion 23 and the side plates 43, 44 of the outer frame 24 and fourth connecting portions 54 for connecting the fourth fitting portion 24 and the side plates 43, 44 of the outer frame 24. The terminal main bodies 21 to 24 are connected and fixed to the outer frame 4 by the connecting portion 5 (51 to 54).

The connector 1 is formed of a body molded using an insulating synthetic resin material, and the fitting portions 21 to 24, the connecting portions 51 to 54 and the outer frame 4 are integrally formed. The connecting portions 51 to 53 are formed to function as resin springs connecting the terminal main portion 3 and the fitting portions 21 to 23. The connecting portions 51 to 53 have a function as a tolerance absorbing portion for absorbing a tolerance due to the stacking of the devices by resilient forces of the resin springs.

The connecting portions 51 to 53 formed as the tolerance absorbing portions are S-shaped or inverted S-shaped plate-like bodies when viewed from front, and one end parts are connected to the outer frame 4 and the other end parts are connected to the fitting portions 21 to 23. Curved parts of the connecting portions 51 to 53 are easily deflectable and easily deformable. The connecting portions 51 to 53 are easily resiliently deformed and function as the resin springs when a stress is applied in the X or Z direction to the fitting portions 21 to 23.

For example, in the case of inserting the connector 1 into the connector fitting portion 13, if a stress is applied in the X or Z direction to the fitting portions 21 to 23 due to a tolerance, the connecting portions 51 to 53 are accordingly deformed and the terminal main portion 2 of the connector can be fitted into the connector fitting portion 13 of the devices even if the tolerance is present. Further, if the connector 1 is detached from the connector fitting portion 13, deformations of the connecting portions 51 to 53 are restored by resilient forces. The fitting portions 21 to 23 of the connector 1 return to initial predetermined positions.

The connecting portions 51 to 53 respectively independently connect the fitting portions 21 to 23 to the outer frame 4. Thus, the respective connecting portions 51 to 53 can independently absorb tolerances of the respective fitting portions 21 to 23 for the independent fitting portions 21 to 23. By forming the connecting portions 51 to 53 so that the tolerances of the fitting portions can be independently absorbed in this way, the connector can be more reliably fitted by satisfactorily correcting the alignment of the terminals even if tolerances are large.

Differently from the above connecting portions 51 to 53, the fourth connecting portions 54 are so formed that the connector fitting portion 24 is fixed to the outer frame 4. The fourth connecting portions 54 do not function as tolerance absorbing portions. Specifically, the fourth connecting portions 54 linearly connect an upper surface part of the fourth fitting portion 24 to the left and right side plates 43, 44. Further, the bottom surface of the fitting portion 24 is connected and united with the bottom plate 42. The fourth fitting portion 24 is fixed to the outer frame 4 and connected to and held by the terminal holding portion 2 so as not to be deformed when a stress is applied to the fitting portion 24.

The fourth connecting portions 54 connected to the fourth fitting portion 24 are not deformed even if a stress is applied to the fitting portion 24. Thus, the fourth connecting portions 54 can serve as a reference position for dimensions in fitting the connector 1 into the connector fitting portion 13.

Note that although the fourth fitting portion is connected and fixed to the terminal holding portion so as not to be deformed and is formed to serve as a reference in the above embodiment, there is no particular limitation to this form. Specifically, the fitting portion to be fixed to the terminal holding portion may be another one of the four fitting portions. Preferably, one of a plurality of fitting portions is fixed to the terminal holding portion and the other fitting portions are connected to independently serve as the tolerance absorbing portions by the connecting portions. Further, the fitting portion fixed to the terminal holding portion is preferably the one on a central side. This can ensure a maximum permissible range when a tolerance is large since a distance from the fixed fitting portion to the most distant fitting portion can be shortest.

Further, in the connector 1, a lock portion 6 for fixing a fitted state when the connector 1 is fitted into the connector fitting portion 13 of the devices 11 is provided on the left side plate 43 of the outer frame 4. A locking portion (not shown) for locking a lock claw of the lock portion 6 is provided at a position corresponding to the lock portion on the devices 11. The connector 1 can be fixed so as not to be disconnected from the devices 11 by locking the lock portion 6 by the locking portion when the connector 1 is fitted into the connector fitting portion of the devices 11.

Figure 8:
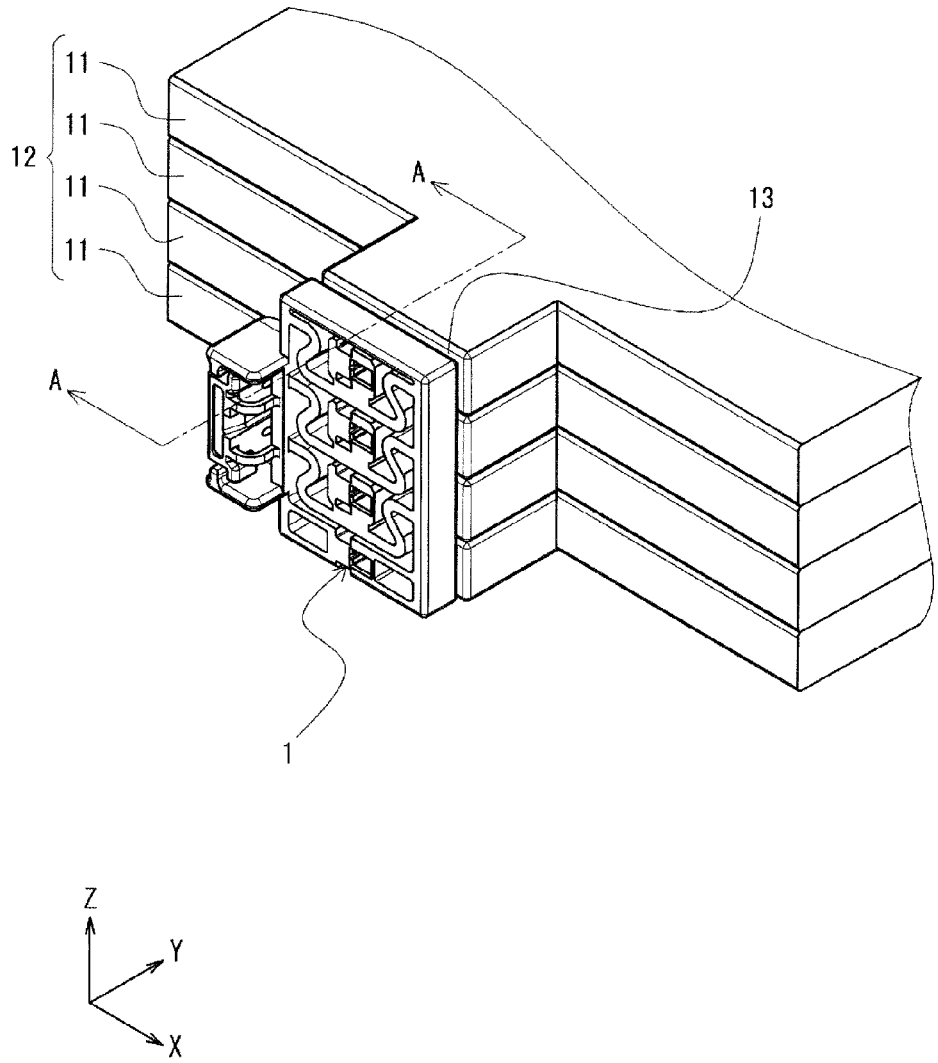
FIG. 8 is a perspective view showing a state where the connector is fitted to devices.
Figure 9:
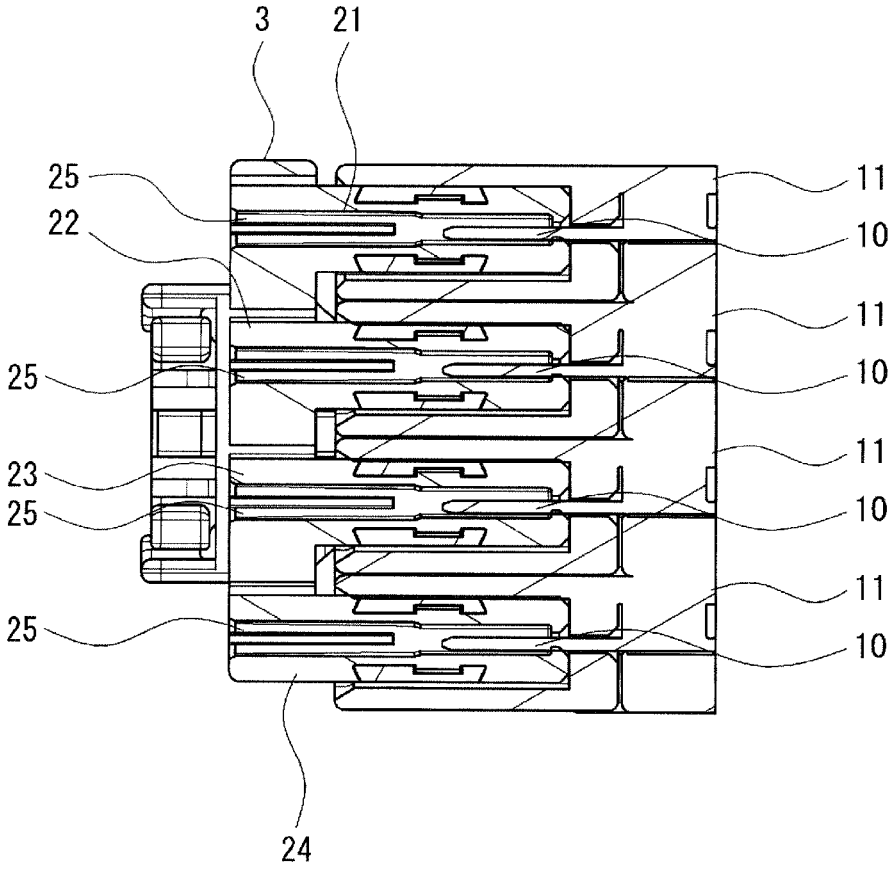
FIG. 9 is a vertical section along A-A of FIG. 8.
Figure 10:
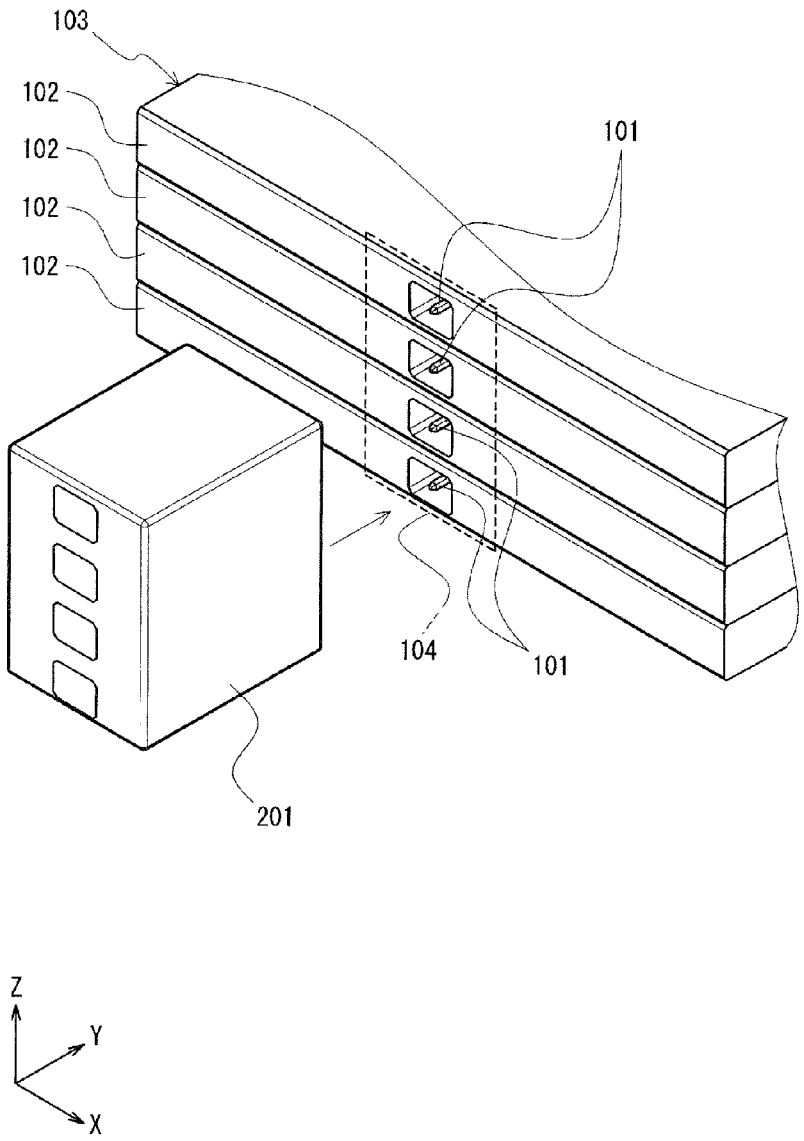
FIG. 10 is a view schematically showing a conventional connector and stacked devices.

FIG. 8 is a perspective view showing a state where the connector of FIG. 1 is fitted into the connector fitting portion, and FIG. 9 is a vertical section along A-A of FIG. 8. The connector 1 is fitted by inserting the four fitting portions (first fitting portion 21 to fourth fitting portion 24) of the terminal main portion 3 into the connector fitting portion 13 of the stacked body 12 in which the four devices 11 are stacked. The terminals 25 of the respective fitting portions of the connector 1 are electrically connected to the terminals 10 of the devices. In this case, even if the positions of the recesses 14 of the devices 11 are displaced in the vertical direction (Z direction) and the lateral direction (Z direction) due to a stacking tolerance, the connecting portions 51 to 54 are deflected and deformed in the X direction and the Z direction. The fitting portions 21 to 23 follow displacements of the recesses 14. The terminal main portion 2 of the connector 1 is easily inserted and fitted into the connector fitting portion 13 of the stacked body 12 of the devices. In this way, the connector 1 absorbs a tolerance due to the stacking of the devices by the deflection of the resin springs of the connecting portions 51 to 53. Note that since the fitting portion 24 is not deformed, it serves as a reference for the connection position of the connector.

The connector of the present invention is not limited to the mode of the above embodiment and can be modified. For example, although the terminal main portion 2 is composed of four fitting portions 21 to 24 in the above embodiment, the number of the fitting portions is not particularly limited as long as it is not smaller than two and the fitting portions can be formed according to the number of mating terminals.

Further, although the terminal holding portion 3 is provided around the rear side of the terminal main portion 2 in the above embodiment, it may be provided on the right or left side surface of the terminal main portion 2.

In the above embodiment, the connecting portion 5 formed as the tolerance absorbing portions is shaped to be easily deformable in the Z direction and X direction and has a structure capable of absorbing a dimensional tolerance in two directions of the Z and X directions. Contrary to this, the connecting portion 5 may be formed as a tolerance absorbing portion easily deformable in X and Y directions. Specifically, the resin springs of the connecting portion 5 made of curved plate-like bodies used in the above embodiment may be so mounted that flat surfaces extend in the vertical direction instead of extending in the horizontal direction. By forming the connecting portion 5 in this way, it is possible to obtain a structure capable of absorbing a dimensional tolerance in two directions of the X and Y directions.

The invention claimed is:

1. A connector for collectively connecting terminals of a plurality of devices, the plurality of devices being stacked to define a stacked body, and the terminals of the stacked body being on an end part of the stacked body, the connector comprising:

a terminal holding frame;

a first fitting portion and a plurality of second independent fitting portions arranged in a stacked posture inward of the frame and configured for connection to the respective terminals of the devices; and a first connecting portion integrally connecting the first fitting portion and the terminal holding frame in a fixed manner and a plurality of resiliently deformable second connecting portions integrally connecting the plurality of second independent fitting portions and the terminal holding frame and capable of resiliently accommodating movement of the plurality of second independent fitting portions relative to one another, to the first connection portion, and to the terminal holding frame for absorbing a tolerance due to the stacking of the devices.

2. The connector of claim 1, wherein at least two of the resiliently deformable connecting portions are provided for each of the plurality of second independent fitting portion to independently absorb the tolerance.

3. A connector according to claim 1, wherein the first connecting portion and the plurality of second connecting portions are provided on rear end parts of the first fitting portion and the plurality of second independent fitting portions, respectively.

4. The connector of claim 2, wherein each of the resin springs is a curved plate-shaped body.

5. The connector of claim 4, wherein each of the resin springs has two curves to define an S-shape.

6. The connector of claim 5, wherein the resin springs of each fitting portion are arranged symmetrically.

7. The connector of claim 4, wherein each of the resin springs is curved to permit the respective fitting portion to move in directions perpendicular to a connecting direction of the respective fitting portion to the stacked devices.

* * * * *